US008602185B1

(12) United States Patent
White

(10) Patent No.: US 8,602,185 B1
(45) Date of Patent: Dec. 10, 2013

(54) TRAVEL BAG THAT CAN SERVE AS A WALKER

(76) Inventor: Joan White, Wynnewood, PA (US)

( * ) Notice: Subject to any disclaimer, the term of this patent is extended or adjusted under 35 U.S.C. 154(b) by 126 days.

(21) Appl. No.: 13/292,041

(22) Filed: Nov. 8, 2011

(51) Int. Cl.
*A47C 7/62* (2006.01)

(52) U.S. Cl.
USPC ..... 190/1; D12/133; D12/130; D12/131; 135/66; 224/407; 224/42.46; 280/30; 280/288.4

(58) Field of Classification Search
USPC ..... 190/1; 135/242, 65, 67; 224/407; 280/30, 42, 5.32, 47.26, 639, 641, 645, 280/652, 654, 87.05; 482/68; D12/133
See application file for complete search history.

(56) References Cited

U.S. PATENT DOCUMENTS

| | | | | | |
|---|---|---|---|---|---|
| 3,804,431 | A | * | 4/1974 | Robinson | 280/645 |
| 3,945,660 | A | * | 3/1976 | Zalewski | 280/42 |
| 3,957,071 | A | * | 5/1976 | Kenner | 135/66 |
| 4,294,464 | A | * | 10/1981 | Ettridge | 280/649 |
| 4,700,730 | A | * | 10/1987 | Samuelson et al. | 135/67 |
| D315,702 | S | * | 3/1991 | Van Dyke | D12/133 |
| 5,192,092 | A | * | 3/1993 | DiBenedetto | 280/654 |
| 5,462,103 | A | * | 10/1995 | Effa | 150/154 |
| 5,607,129 | A | * | 3/1997 | Kim | 248/98 |
| 6,311,708 | B1 | * | 11/2001 | Howle | 135/67 |
| 6,942,130 | B1 | * | 9/2005 | Duva | 224/407 |
| D558,100 | S | * | 12/2007 | Dancy | D12/133 |
| 7,984,724 | B1 | * | 7/2011 | Eberle | 135/67 |
| 2010/0313924 | A1 | | 12/2010 | Cho | |

* cited by examiner

*Primary Examiner* — Anthony Stashick
*Assistant Examiner* — Cynthia Collado
(74) *Attorney, Agent, or Firm* — LaMorte & Associates, P.C.

(57) ABSTRACT

A combined luggage bag and walker assembly having side frame elements. Forward wheels are affixed to the bottom each of the side frame elements. Handles are coupled to the top end of the side frame elements. Two leg elements are pivotably connected to the side frame elements at pivot connections. The leg elements are free to rotate about the pivot connections between a closed configuration and an open configuration. Linkages lock the leg elements into their open configuration. Rearward wheels are coupled to each of the leg elements proximate its free end. A luggage bag is attached between the side frame elements. A confined area exists behind the luggage bag. The confined area is defined by the luggage bag in front and the leg elements on either side. A person needing the assistance of a walker stands and walks in the confined area while grasping the handles.

15 Claims, 6 Drawing Sheets

TRAVEL BAG THAT CAN SERVE AS A WALKER

BACKGROUND OF THE INVENTION

1. Field of the Invention

In general, the present invention relates to travel bags that have retractable handles and other such features. The present invention also relates to the structure of collapsible walkers. More particularly, the present invention relates to assemblies that contain the features of both a travel bag and a walker.

2. Prior Art Description

Many people benefit from the use of a walker as they walk. A walker provides physical support to a person so that a person can support his/her own weight with both their arms and their legs. This added support can prevent a person from falling if they mis-step or if their legs are otherwise unable to bear their full weight.

Although walkers are highly beneficial to many people, walkers do have some drawbacks. The primary drawback of a walker is that it is bulky. As such, a walker is very difficult to transport when it is not being used. Walkers are therefore difficult to move in and out of automobiles, airplanes, restaurants seats and other confined spaces.

One of the most difficult places to use a walker is when traveling on an airplane. Traditional walkers are typically too large to be stored in the overhead compartment of the airplane. As such, the walker must be checked as luggage. However, if the walker is checked as luggage, it cannot be used to help a person board the airplane. As a consequence, people who otherwise could manage on their own with a walker are now required to be helped onto the airplane by airline employees who have a wheelchair.

In the prior art, there are many walker designs that are collapsible. Some of these designs may produce a walker small enough to fit into the overhead compartment of a commercial airplane. However, another disadvantage of a walker is that a person must use both hands to grasp the walker. This leaves no free hand to carry or pull a carry-on bag. Accordingly, even if a walker could be made to fit into an airplane overhead compartment, a user would not be able to bring anything other than the walker onto the airplane.

In the prior art, people have recognized that the use of a walker prevents a person from carrying any secondary bag. This problem has been addressed in the prior art by adding carry bags to the frame of the walker. Such devices are disclosed in U.S. Patent No. 2010/0313924 to Cho, entitled Foldable Walker Apparatus. However, in order to keep the walker collapsible, the pockets have to be very thin and narrow. Accordingly, the pocket capacity of such designs are very small.

A need therefore exists for a carry-on bag that is sized to fit into the overhead compartment of a commercial airplane that is also configured to serve as a functioning walker. In this manner, a person can use the device as a walker as they board and leave an airplane. The device can also serve as a standard piece of carry-on luggage for holding items. In this manner, a person who requires the use of a walker can board an airplane unassisted and need not be denied a functional piece of carry-on luggage. These needs are met by the present invention as described and claimed below.

SUMMARY OF THE INVENTION

The present invention is a combined luggage bag and walker assembly. The assembly has two side frame elements, wherein each of the side frame elements has a top end and a bottom end. Cross bar elements are used to interconnect the side frame elements and position said side frame elements in parallel planes a predetermined distance apart.

The assembly has forward wheels. The forward wheels are affixed to the bottom end of each of the side frame elements. Handles are coupled to the top end of the side frame elements. Two leg elements are pivotably connected to the side frame elements at pivot connections. Each of the leg elements has a pivot end and a free end. Furthermore, each of the leg elements is free to rotate about its pivot connection between a closed configuration and an open configuration.

Linkages are disposed between the leg elements and the side frame elements. The linkages selectively lock the leg elements into their open configuration. Rearward wheels are coupled to each of the leg elements proximate the free ends.

A luggage bag is provided that has a back panel and side panels. The back panel of the luggage bag is coupled to the cross bar elements. Furthermore, the side panels of the luggage bag are coupled to the side frame elements. The leg elements are oriented at an acute angle with the back panel of the luggage bag when the leg elements are in the open configuration.

A confined area now exists behind the luggage bag. The confined area is defined by the luggage bag in front and the leg elements and handles on either side. A person needing the assistance of a walker stands and walks in the confined area while grasping the handles. Since the luggage bag is affixed to the walker framework, it moves with the walker framework and need not be separately carried.

BRIEF DESCRIPTION OF THE DRAWINGS

For a better understanding of the present invention, reference is made to the following description of two exemplary embodiments thereof, considered in conjunction with the accompanying drawings, in which.

DETAILED DESCRIPTION OF THE DRAWINGS

Although the present invention assembly can be embodied in many ways, the illustrations only show two embodiments. These embodiments are selected in order to set forth the best modes contemplated for the invention. The illustrated embodiments, however, are merely exemplary and should not be considered a limitation when interpreting the scope of the appended claims.

Figure 1:
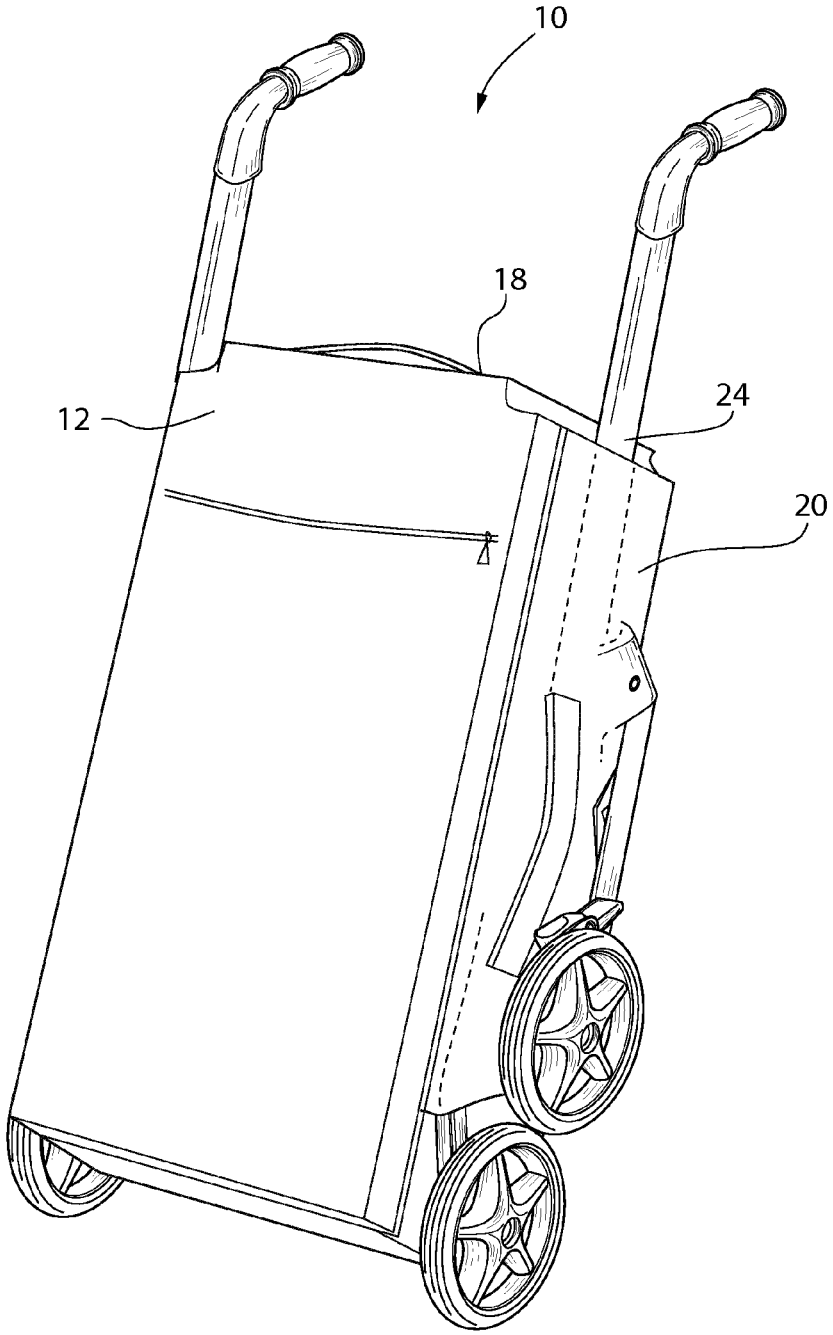
FIG. 1 is a perspective view of an exemplary embodiment of a luggage bag/walker assembly shown configured as wheeled luggage.
Figure 2:
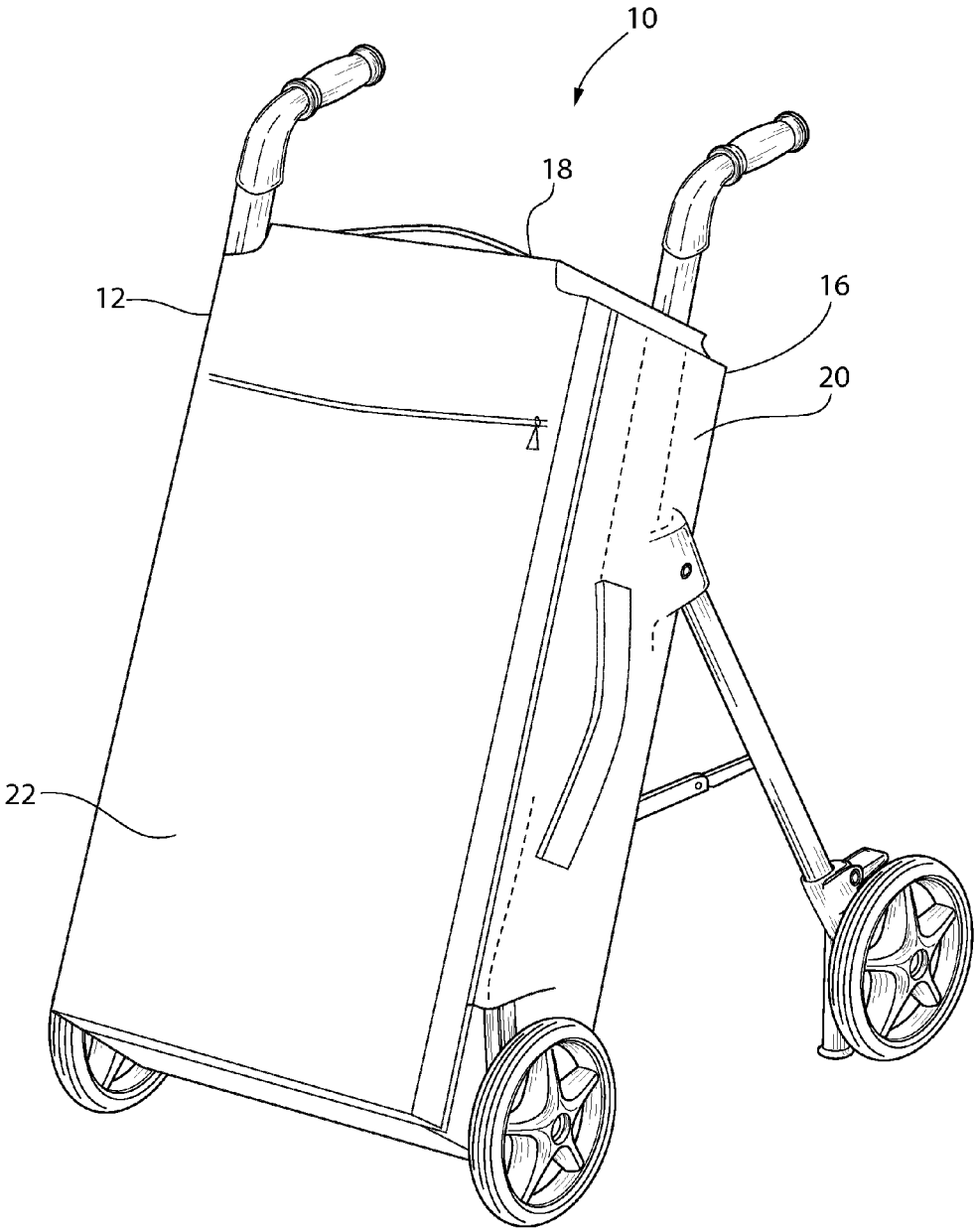
FIG. 2 is a perspective view of the exemplary embodiment of FIG. 1 configured as a walker.

Referring to FIG. 1 and FIG. 2, an assembly 10 is shown that can be configured as a carry-on piece of luggage (FIG. 1) or as a walker (FIG. 2). The assembly 10 includes a luggage bag 12. The luggage bag 12 is preferably sized to meet the carry-on size limitations of commercial airlines. However, larger versions of the assembly 10 can be made. The luggage bag 12 has a back panel 14, a bottom panel 16, a top panel 18 and two side panels 20 that extend between the top panel 10 and the bottom panel 16. The luggage bag 12 has a lid 22 that can be selectively opened and closed to access the interior of the luggage bag 12. The luggage bag 12 may also optionally contain numerous exterior and interior pockets as a matter of design choice.

The luggage bag 12 is integrated with a walker framework 24. The walker framework 24 can be selectively configured into a closed configuration, such as is shown in FIG. 1 or an open configuration, such as is shown in FIG. 2.

Figure 3:
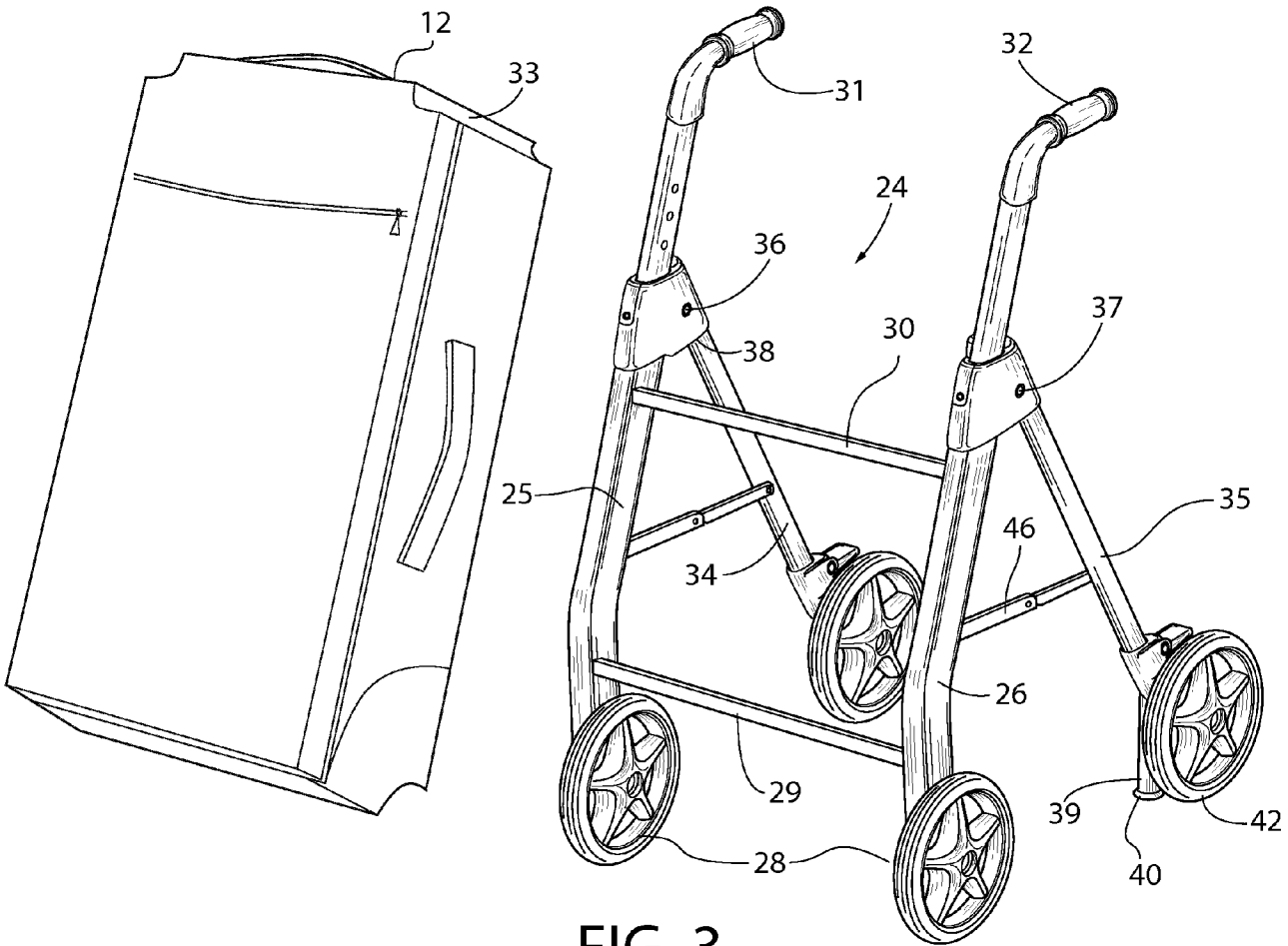
FIG. 3 is an exploded view of the embodiment of FIG. 2.

Referring to FIG. 3 in conjunction with FIG. 1 and FIG. 2, it can be seen that the walker framework 24 includes two side frame elements 25, 26 that extend along the left and right side panels 20 of the luggage bag 12. The bottom ends of the side frame elements terminate with a set of forward wheels 28. The forward wheels 28 can be either caster wheels or fixed wheels. The side frame elements 25, 26 are parallel and are spaced apart by cross bar elements 29, 30 that extend through the back panel 14 of the luggage bag 12. The side frame elements 25, 26 and the cross bar elements 29, 30 are integrated into the structure of the luggage bag 12, it will be understood that the luggage bag 12 and these elements are set at fixed positions relative to one another. Accordingly, when the luggage bag 12 is set on end and tilted for travel, such as is shown in FIG. 1, the luggage bag 12 is supported upon the forward wheels 28.

Two handles 31, 32 interconnect with the top ends of the side frame elements 25, 26. The handles 31, 32 are adjustable in length by being telescopically interconnected with the side frame elements 25, 26. Furthermore, the telescopic interconnection enables the handles 31, 32 to rotate 180 degrees for a purpose that is later explained. When fully retracted into the side frame elements 25, 26, the handles 31, 32 rest within depressions 33 that are formed in the top panel 18 of the luggage bag 12

Two leg elements 34 are provided. Each leg element 34 attaches to a different one of the side frame elements 25, 26 with a corresponding pivot connection 36, 37. Each leg element 34 has a pivot end 38 and a free end 39. The pivot end 38 of each leg element 34 is connected to side frame element 25, 26 at a point proximate the top end of each side frame element 25, 26. The free end 39 of each leg element 34 terminates with a stopper 40. A rearward wheel 42 is mounted to each leg element 34 proximate the stopper 40. The wheel 42 is spring loaded and is biased by a spring 44 (FIG. 5) to extend beyond the stopper 40. However, if a small predetermined force is applied to the leg elements 34, the springs 44 will compress and the stoppers 40 can contact the underlying surface.

Linkage elements 46 also join the leg elements 34 to the side frame elements 25, 26. The linkage elements 46 enable the leg elements 34 to rotate about the pivot connections 36, 37 at an angle of between thirty degrees and fifty degrees relative to the side frame elements 25, 26 and the plane of the back panel of the luggage bag 12.

Figure 4:
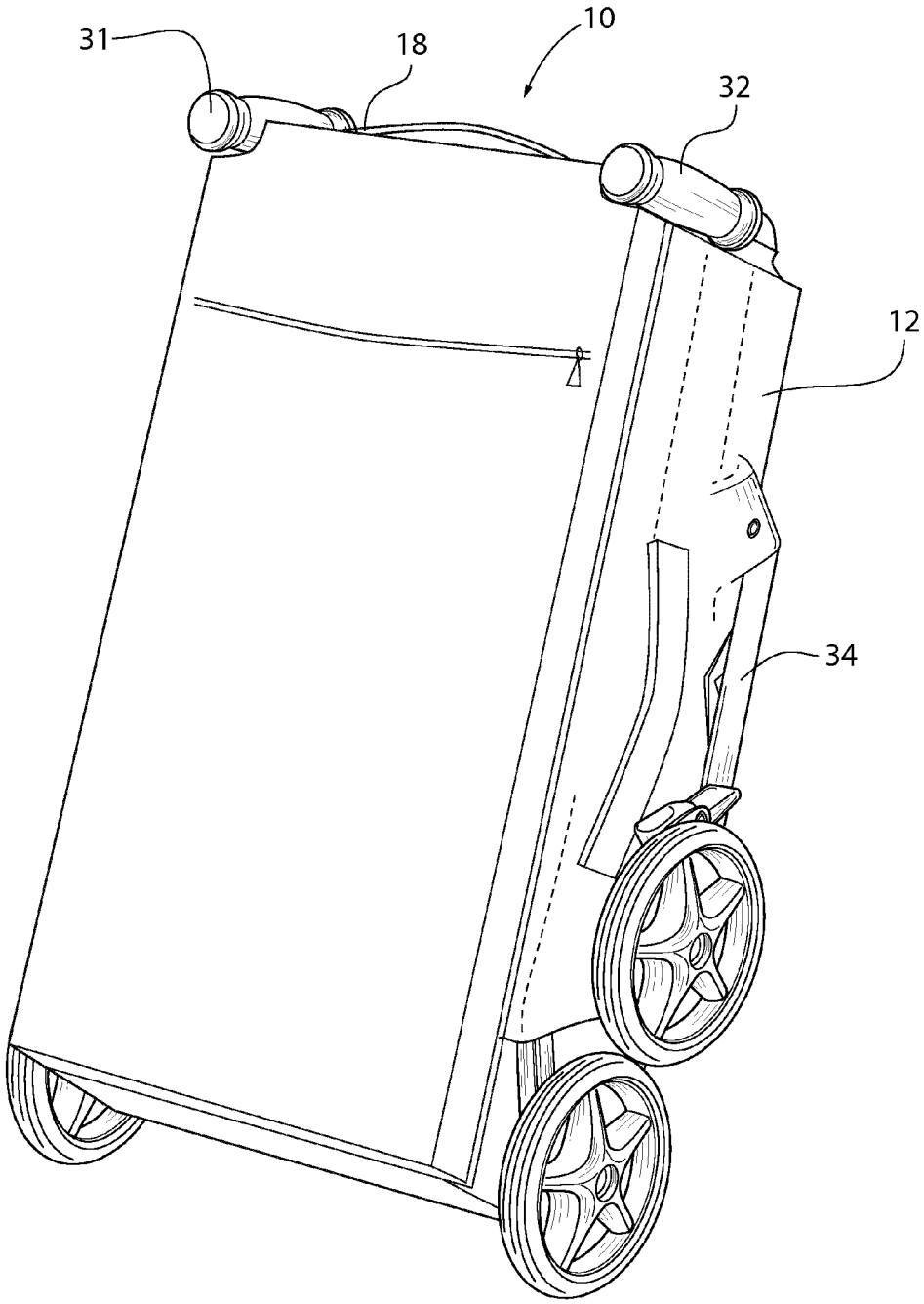
FIG. 4 is a perspective view showing the exemplary embodiment of the present invention configured in its fully compact state.

Referring to FIG. 4 in conjunction with FIG. 3, it will be understood that the leg elements 34 can be folded against the side frame elements 25, 26. Furthermore, the handles 31, 32 can be rotated to face forward and can be collapsed against the top panel 18 of the luggage bag 12. In this condensed configuration, the assembly 10 is only slightly larger than the luggage bag 12 itself. The overall dimensions of the full assembly 10 are preferably small enough to enable the assembly 10 to fit into the overhead compartment of a commercial airplane. However, larger version can be made.

Referring to FIG. 1 in conjunction with FIG. 3, it will be understood that the assembly 10 can serve as wheeled luggage if no walker is needed. To achieve this configuration, the handles 31, 32 are extended and are rotated to face rearwardly. Using the extended handles 31, 32, a person can easily tilt the luggage bag 12 onto its forward wheels 28. The luggage bag 12 can then be pushed or pulled as an ordinary piece of wheeled luggage.

Figure 5:
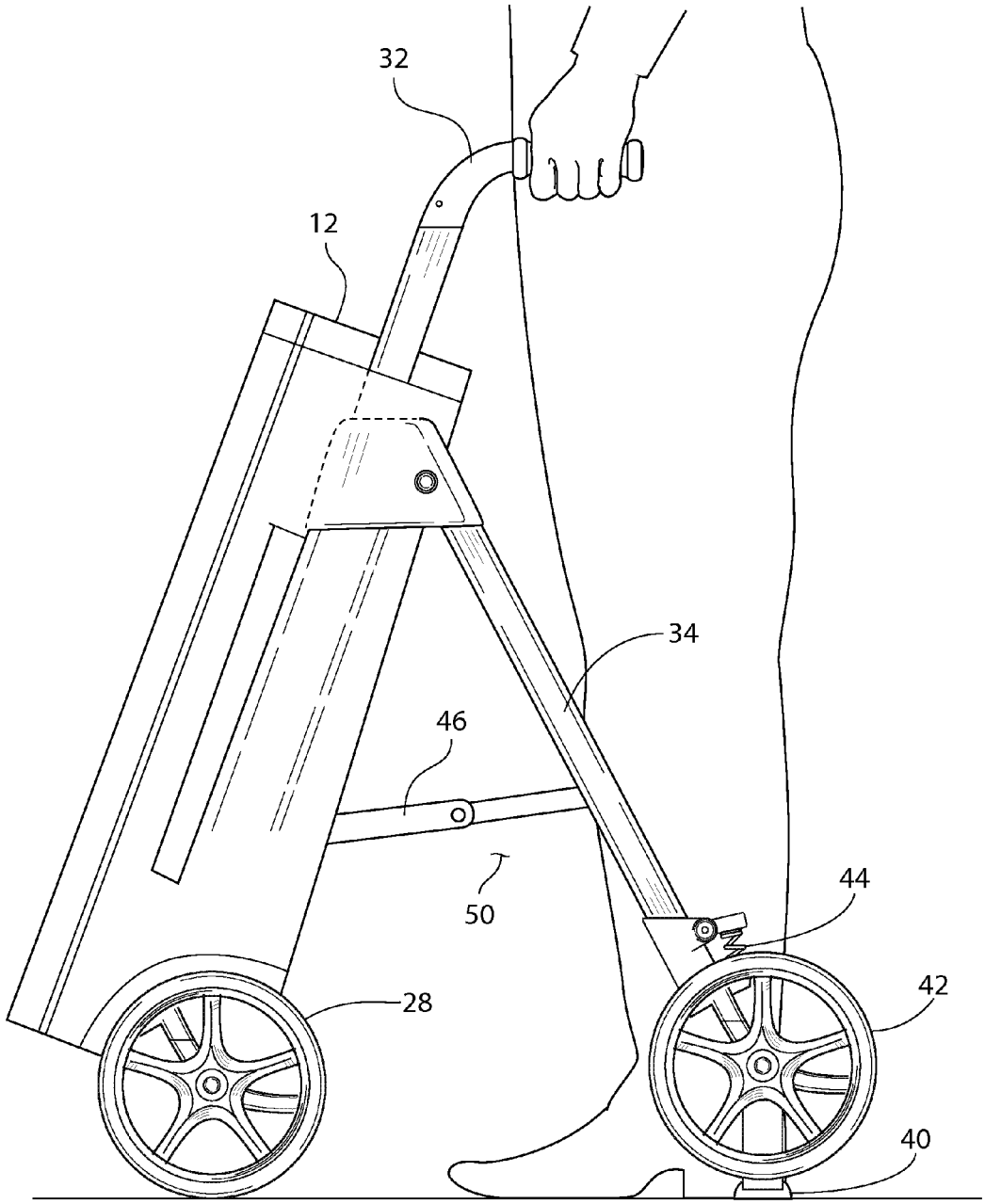
FIG. 5 shows a side view of the embodiment of FIG. 2.

Referring to FIG. 5 in conjunction with FIG. 2 and FIG. 3, it will be understood that if a walker is needed, the handles 31, 32 are extended and are rotated to face rearwardly. Furthermore, the leg elements 34 are extended to the maximum degree allowed by the linkage elements 46. This causes the walker framework 24 to create a stable four-point configuration. It also causes the handles 31, 32 to be vertically aligned with points between the forward wheels 28 and the rearward wheels 42. Consequently any weight applied to the handles 31, 32 will be borne by both the forward wheels 28 and the rearward wheels 42. The result is that the four-point configuration remains stable and safe even if a person is placing most of his/her weight on the handles 31, 32.

The luggage bag 12 is affixed to the side frame elements 25, 26. Therefore, the majority of the weight of the luggage bag 12 and its contents are borne by the forward wheels 28, which are positioned under the luggage bag 12.

A confined area 50 exists behind the luggage bag 12. The confined area 50 is defined by the luggage bag 12 in front and the leg elements 34 and handles 31, 32 on either side. A person needing the assistance of a walker stands and walks in the confined area 50 while grasping the handles 31, 32. Since the luggage bag 12 is affixed to the walker framework 24, it moves with the walker framework 24 and need not be separately carried. As such, a person need not hold the luggage bag 12 and need only grasp the two handles 31, 32.

As a person presses down upon the handles 31, 32, the spring bias of the rear wheels 42 compresses and the stoppers 40 touch the underlying surface. This makes the assembly 10 very stable and enables a person to bear their full weight upon the handles 31, 32 without the assembly 10 moving. However, when a person walks, they gently push the handles 31, 32 forward. This enables the rear wheels 42 to extend and the entire assembly 10 can roll forward on its wheels 28, 42.

Figure 6:
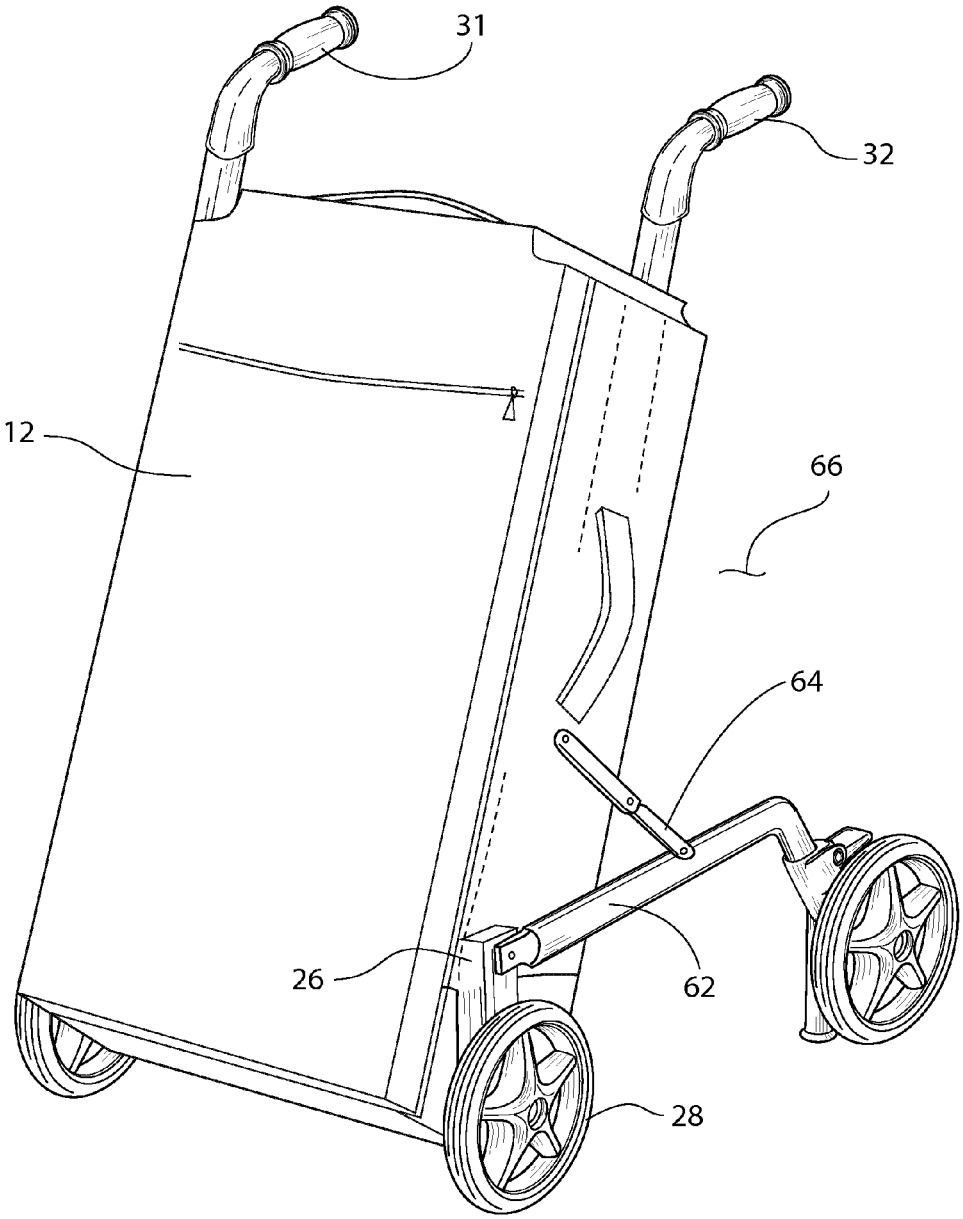
FIG. 6 shows an exemplary embodiment of an alternate embodiment of the present invention.

Referring to FIG. 6, an alternate embodiment of the present invention assembly 60 is shown. In this embodiment, the side frame elements 26, forward wheels 28 and handles 31, 32 are the same as has been previously described. Accordingly, to avoid confusion, these elements are defined by the same reference numbers as were previously used. In this embodiment, two leg elements 62 are pivotably connected to the side frame elements 26 near the forward wheels 28. The two leg elements 62 can be selectively rotated downwardly and locked into place using locking linkages 64. This causes the walker framework 68 to create a stable four-point configuration. The luggage bag 12 is affixed to the side frame elements 26. The majority of the weight of the luggage bag 12 and its contents are borne by the forward wheels 28, which are positioned under the luggage bag 12.

A confined area 66 now exists behind the luggage bag 12. The confined area 66 is defined by the luggage bag 12 in front and the leg elements 62 on either side. A person needing the assistance of a walker stands and walks in the confined area 66 while grasping the handles 31, 32. Since the luggage bag 12 is affixed to the walker framework 68, it moves with the walker framework 68 and need not be separately carried. As such, a person need not hold the luggage bag 12 and need only grasp the two handles 31, 32.

With the leg elements 62 extended, the assembly 60 is now very stable and enables a person to bear their full weight upon the handles 31, 32 without the assembly 60 moving. However, when a person walks, they gently lift and push the handles 31, 32 forward. This enables the entire assembly 60 to roll forward on its wheels.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A combined luggage bag and walker assembly, comprising:

two side frame elements, wherein each of said side frame elements has a top end and a bottom end;

cross bar elements that interconnect said side frame elements and position said side frame elements in parallel a predetermined distance apart;

forward wheels, wherein one of said forward wheels is affixed to said bottom end of each of said side frame elements;

handles coupled to said top end of each of said side frame elements;

two leg elements pivotably connected to said side frame elements at pivot connections, each of said leg elements having a pivot end and a free end, wherein each said free end terminates with a stopper, and wherein each of said leg elements is free to rotate about said pivot connections between a closed configuration and an open configuration;

linkages disposed between said leg elements and said side frame elements that selectively lock said leg elements into said open configuration;

rearward wheels coupled to each of said leg elements proximate each said free end, wherein said rearward wheels are spring biased and extend from said leg elements beyond each said stopper;

a luggage bag having a back panel and side panels, wherein said back panel of said luggage bag is coupled to said cross bar elements and said side panels are coupled to said side frame elements;

wherein said leg elements are oriented at an acute angle with said back panel of said luggage bag when said leg elements are in said open configuration.

2. The assembly according to claim 1, wherein each of said handles is selectively extendable from said top end of said side frame elements to a fully extended position.

3. The assembly according to claim 2, wherein said handles are rotatably adjustable in orientation relative said side frame elements.

4. The assembly according to claim 3, wherein said top panel of said luggage bag contains depressions for receiving said handles therein when said handles are fully retracted within said side frame elements.

5. The assembly according to claim 2, wherein said handles are vertically aligned with a position between said forward wheels and said rearward wheels when said leg elements are in said open configuration and said assembly rests upon said forward wheels and said rearward wheels.

6. The assembly according to claim 1, wherein said back panel of said luggage bag and said leg elements define three sides of a confined area in which a person can walk while holding said handles.

7. A combined luggage bag and walker assembly, comprising:

two side frame elements in parallel planes that are separated by a gap space, wherein each of said side frame elements has a top end and a bottom end;

forward wheels, wherein one of said forward wheels is affixed to said bottom end of each of said side frame elements;

handles coupled to said top end of said side frame elements, wherein said handles are retractable toward said side frame elements;

two leg elements pivotably connected to said side frame elements at pivot connections, each of said leg elements having a pivot end and a free end, wherein each of said leg elements is free to rotate about said pivot connections between a closed configuration and an open configuration;

linkages disposed between said leg elements and said side frame elements that selectively lock said leg elements into said open configuration;

a luggage bag disposed in said gap space between said side frame elements, wherein said luggage bag is coupled to said side frame elements and said luggage bag has side panels that extend in said parallel planes, and wherein said luggage bag contains a top panel with depressions for receiving said handles therein when said handles are retracted toward said side frame elements.

8. The assembly according to claim 7, further including rearward wheels that are coupled to each of said leg elements proximate said free end.

9. The assembly according to claim 8, wherein each said free end of said leg elements terminate with a stopper.

10. The assembly according to claim 9, wherein each of said rearward wheels are spring biased and extend from said leg elements beyond said stopper.

11. The assembly according to claim 8, wherein each of said handles are selectively extendable from said top end of said side frame elements to a fully extended position.

12. The assembly according to claim 11, wherein said handles are rotatably adjustable in orientation relative said side frame elements.

13. The assembly according to claim 11, wherein said handles are vertically aligned with a position between said forward wheels and said rearward wheels when said leg elements are in said open configuration and said assembly rests upon said forward wheels and said rearward wheels.

14. The assembly according to claim 8, wherein luggage bag has a back panel and wherein said back panel and said leg elements define three side of a confined area in which a person can walk while holding said handles.

15. A combined luggage bag and walker assembly, comprising:

two side frame elements in parallel planes that are separated by a gap space, wherein each of said side frame elements has a top end and a bottom end;

forward wheels, wherein one of said forward wheels is affixed to said bottom end of each of said side frame elements;

handles coupled to said top end of said side frame elements;

two leg elements pivotably connected to said side frame elements at pivot connections, each of said leg elements having a pivot end and a free end, wherein said free end terminates with a stopper, and wherein each of said leg elements is free to rotate about said pivot connections between a closed configuration and an open configuration;

rearward wheels coupled to each of said leg elements proximate said free end, wherein each of said rearward wheels are spring biased and extend from said leg elements beyond said stopper;

linkages disposed between said leg elements and said side frame elements that selectively lock said leg elements into said open configuration; and a luggage bag disposed in said gap space between said side frame elements, wherein said luggage bag is coupled to said side frame elements and said luggage bag has side panels that extend in said parallel planes.

* * * * *